US005867899A

United States Patent [19]

Kim

[11] Patent Number: 5,867,899

[45] Date of Patent: Feb. 9, 1999

[54] METHOD OF MANUFACTURING A HEADER PIPE FOR A HEAT EXCHANGER

[75] Inventor: Yong-Ho Kim, Pyungtaek, Rep. of Korea

[73] Assignee: Halla Climate Control Corporation, Taejon, Rep. of Korea

[21] Appl. No.: 855,522

[22] Filed: May 13, 1997

Related U.S. Application Data

[62] Division of Ser. No. 720,432, Sep. 30, 1996.

[30] Foreign Application Priority Data

Sep. 30, 1995 [KR] Rep. of Korea ..... 95-33995
Mar. 8, 1996 [KR] Rep. of Korea ..... 96-6111

[51] Int. Cl.[6] ..... B23P 15/26

[52] U.S. Cl. ..... 051397/29; 29/890.043; 29/890.054

[58] Field of Search ..... 29/890.052, 890.035, 29/890.03, 890.043, 890.047, 890.07, 557, 890.054; 72/335

[56] References Cited

U.S. PATENT DOCUMENTS

| | | | |
|---|---|---|---|
| 3,411,196 | 11/1968 | Zehnder | 29/890.013 |
| 4,945,635 | 8/1990 | Nobusue et al. | 29/890.043 |
| 5,107,926 | 4/1992 | Calleson | 29/890.052 |
| 5,214,847 | 6/1993 | Aoki | 29/890.052 |
| 5,243,842 | 9/1993 | Kobayashi et al. | 29/890.052 |
| 5,329,990 | 7/1994 | Chigira | 165/153 |
| 5,329,995 | 7/1994 | Dey et al. | 165/153 |
| 5,481,800 | 1/1996 | Hutto et al. | 29/890.043 |
| 5,649,588 | 7/1997 | Lu | 29/890.052 |
| 5,765,633 | 6/1998 | Hu | 29/890.052 |

*Primary Examiner*—Irene Cuda
*Attorney, Agent, or Firm*—Leydig, Voit & Mayer

[57] ABSTRACT

A heat exchanger includes a pair of header pipes spaced a predetermined distance away from each other, a plurality of tubes connected between the header pipes for defining flow paths for a heat exchanging medium and a plurality of fins installed between the tubes for radiating heat from the heat exchanging medium. Each of the header pipes includes a flat bottom portion formed with a plurality of apertures for receiving the plurality of tubes, a pair of vertical walls extending from both side ends of the flat bottom portion and having a plurality of grooves corresponding to the apertures for guiding the tubes, and curved portion extended from the walls and forming a hollow inner space by joining both side edges thereof. The header pipe is manufactured by forming a bottom and a pair of walls approximately perpendicular to the bottom at the side ends of the bottom by bending a sheet member coated with a cladding layer, forming a plurality of apertures for receiving a plurality of tubes in the bottom and a plurality of grooves for guiding the tubes and extending from the apertures in the walls, forming a curved portion by bending both side edges of the vertical walls, and joining the side edges of the curved portion by brazing.

3 Claims, 16 Drawing Sheets

METHOD OF MANUFACTURING A HEADER PIPE FOR A HEAT EXCHANGER

This disclosure is a division of patent application Ser. No. 08/720,432, filed Sep. 30, 1996.

BACKGROUND OF THE INVENTION

The present invention relates to a heat exchanger, and more particularly, to a heat exchanger having an improved header pipe and a manufacturing method of the header pipe.

Various types of heat exchangers such as a fin-tube type, a serpentine type and a parallel-flow type, are used depending on the characteristics of the heat exchange medium and the pressure in use. With freon gas used as the heat exchange medium being replaced by a heat exchange medium having an ozone depleting potential (ODP) of zero, the parallel-flow type heat exchanger is reputed to be most suitable due to its superior performance as well as small size and light weight.

FIG. 1 shows a general parallel-flow type heat exchanger. The heat exchanger 100 is comprised of a pair of header pipes 111 and 111' spaced by a predetermined distance and a plurality of flat tubes 112 which are disposed between the header pipes 111 and 111' to communicate therewith. The heat exchange medium flows through the header pipes 111 and 111' and the tubes 112. Fins 113 for enlarging the surface area for dissipating heat are formed between the tubes 112 and a cap 114 is provided at one end of each header pipe. The heat exchange medium is supplied via an inlet pipe 111*a* connected to the header pipes 111 and 111' and discharged via an outlet pipe 111*a*' after flowing through the header pipes 111 and 111' and the tubes 112. A baffle can be installed in the header pipes 111 and 111' to change the flow path of the heat exchange medium.

FIGS. 2A–2H schematically show a process of manufacturing a conventional header pipe for use in the heat exchanger 100 shown in FIG. 1, the process being disclosed in U.S. Pat. No. 4,945,635.

In the manufacturing process of the conventional header pipe, an aluminum sheet member, which is coated with an aluminum cladding layer thereon, is employed. An aluminum sheet member 221 as shown in FIG. 2A has the length corresponding to the length of a complete header pipe and the width being the same as or larger than the circumference of the sectional area of a completed header pipe, respectively. In FIG. 2B, slits 222 for receiving a baffle (not shown) are formed in the aluminum sheet member 221. The baffle is inserted into the header pipe through the slit 222 to change or limit the flow path of the heat exchange medium. The formation of the slits 222 and the use of the baffle are optional.

In FIG. 2C, the mid-section along the length of the sheet member 221 is rolled to form a semi-cylindrical portion member 221*a*, and as shown in FIG. 2D, a plurality of tube connecting apertures 223 into which the tubes 112 are inserted are formed at predetermined intervals in the semi-cylindrical portion member 221*a*. Next, a rolling process is performed to flat portions member 221*b* where the slits 222 are formed to form the sheet member 221 into a cylinder form. Here, a header pipe 225 is completed in the shape shown in FIG. 2F, via the shape shown in FIG. 2E. FIG. 2G is a view for explaining the flat tubes 226 having the fins 227 arranged therebetween are assembled into the tube connecting apertures 223 formed in the header pipe 225. The coupled header pipe 225 and the tubes 226 are completely coupled by brazing. FIG. 2H is a cross section showing a state where the tube and the header pipe are coupled by brazing.

There are some problems in the header pipe 225 having the above structure due to its shape. First, in the process of manufacturing the tube connecting aperture 223 in the header pipe 225 using a press, as shown in FIG. 2H, deformation occurs around a burred portion 223' of the tube connecting aperture 223, or the contact thickness (t') of the tube and the header pipe becomes less than the thickness (t) of the header pipe 225 since the tube connecting aperture 223 is formed on a curved surface and not on a plane, and as a result, the tube connecting aperture ends up being angled rather than vertical. Accordingly, the coupling of the burred portion of the tube 226 and the inner surface of the tube connecting aperture 223 of the header pipe 225 becomes unstable, and thus, though the brazing is performed, the junction therebetween is rendered incomplete to thereby cause leakage of the heat exchange medium. Also, an unnecessary space is formed around the tube 226 inserted into the inside of the header pipe 225 so that the flow efficiency of the heat exchange medium is lowered, the necessary amount of charge of the heat exchange medium is increased, and the size of the header pipe is increased. Thus, the miniaturization and lightness of the heat exchanger are hindered. Besides, it is difficult to adjust the depth to which the tube 226 is to be inserted into the header pipe 225 during manufacturing. Also, the area for brazing the tubes 226 to the header pipe 225 is limited only between the tubes and the apertures.

FIG. 3 shows a cross section of another conventional header pipe. The header pipe is manufactured by, first, rolling first and second sheet members 331 and 332 into a semi-cylindrical shape at a predetermined curvature and braze-coupling the sheet members 331 and 332. Both side edges of the first sheet member 331 are bent outward and again towards and overlaying the sheet member 332. The two sheet members are braze-coupled at positions indicated by reference numeral 334 between the inner surface of the bent portions 333 of the first sheet member 331 and the outer surface of both side edges of the second sheet member 332.

However, since the header pipe is constituted by separate members, a work process becomes complicated and the inside pressure of the header pipe is relatively lowered. Also, a complicated jig for joining the members is required when the members are put into a furnace for braze-coupling.

SUMMARY OF THE INVENTION

To solve the above problems, it is an object of the present invention to provide a heat exchanger having a header pipe having an improved shape.

It is another object of the present invention to provide a method for manufacturing a header pipe having an improved shape in a heat exchanger.

Accordingly, to achieve the first object, there is provided a heat exchanger having a pair of header pipes spaced a predetermined distance away from each other, a plurality of tubes connected between the header pipes for defining flow paths for a heat exchanging medium and a plurality of fins installed between the tubes for radiating heat from the heat exchanging medium, each of the header pipes comprising: a flat bottom portion formed with a plurality of apertures for receiving the plurality of tubes; a pair of vertical walls extending from both side ends of the flat bottom portion and having a plurality of grooves corresponding to the apertures for guiding the tubes; and a curved portion extended from the vertical walls and forming a hollow inner space by joining both side edges thereof.

It is preferred in the present invention that the header pipe further comprise a second horizontal surface disposed between the vertical walls and the curved portion and extending from the vertical walls.

According to another preferred embodiment of the present invention, the header pipe further comprises bulged portions which bulge outward and are disposed between the vertical walls and the curved portion.

To achieve the second object, there is provided a method for manufacturing a header pipe for a heat exchanger comprising the steps of: forming a flat bottom portion and a pair of vertical walls approximately perpendicular to the side ends of the bottom on a sheet member coated with a cladding layer; forming a plurality of tube connecting apertures for receiving a plurality of tubes in the flat bottom portion and a plurality of tube guide grooves extending from the tube connecting apertures on the vertical walls; forming a curved portion by bending both side edges of the vertical walls; and joining the side edges of the curved portion by brazing.

According to another characteristic of the present invention, the method for manufacturing a header pipe for a heat exchanger further comprises the step of forming a bulged portion bulging outward between the vertical walls and the curved portion such that the end portion of the tube des not contact the interior surface of the curved portion when the tube is inserted into the header pipe.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

A manufacturing method of a header pipe for a heat exchanger according to an embodiment of the present invention will be described in detail with reference to FIGS. 4A–4D.

Figure 1:
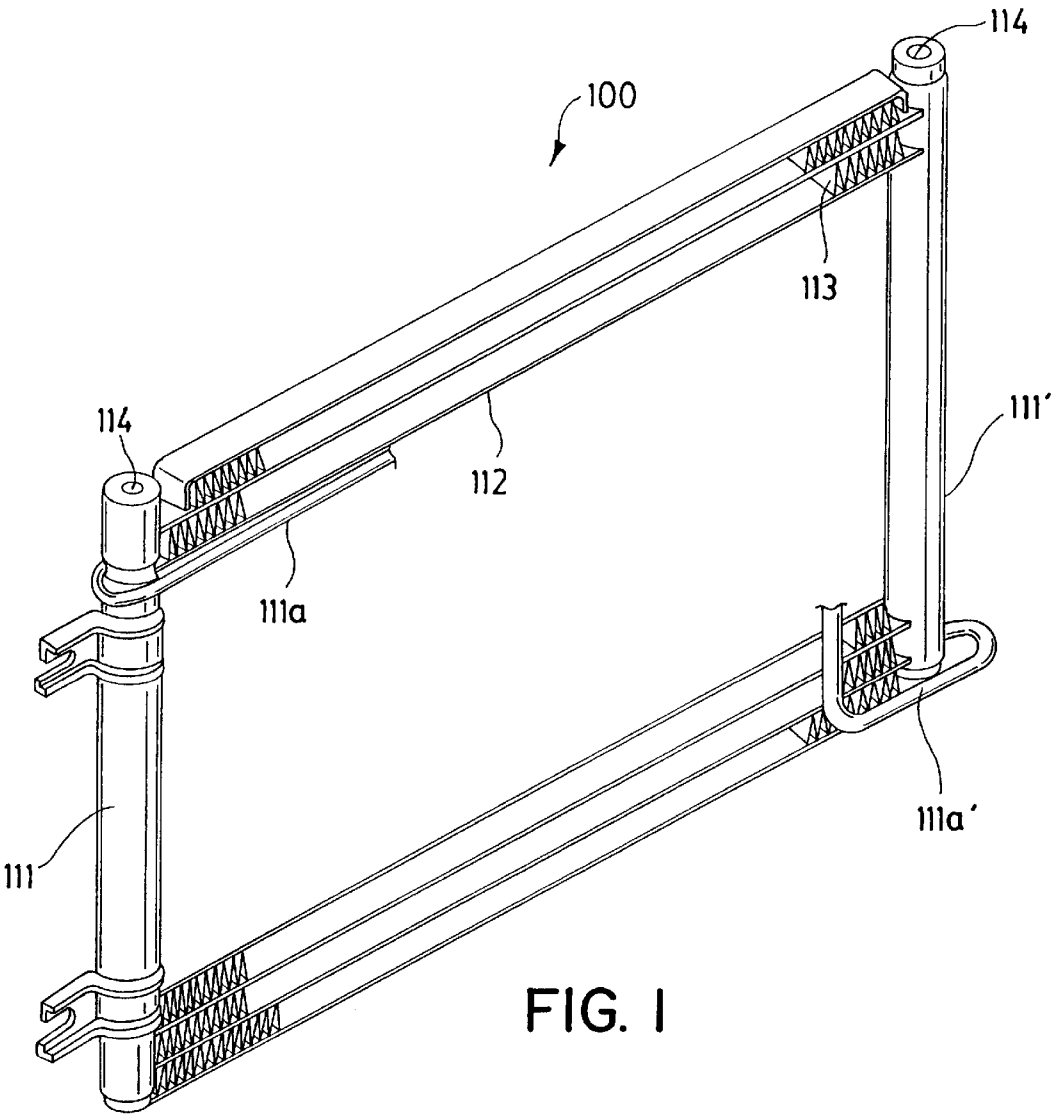
FIG. 1 is a perspective view illustrating a general heat exchanger.
Figure 2A:
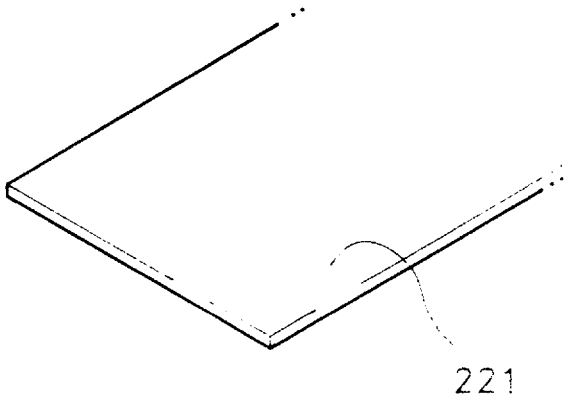
FIG. 2A (PRIOR ART)
FIGS. 2A–2H are perspective views for explaining a manufacturing process of a header pipe for a heat exchanger according to the conventional technology.
Figure 2B:
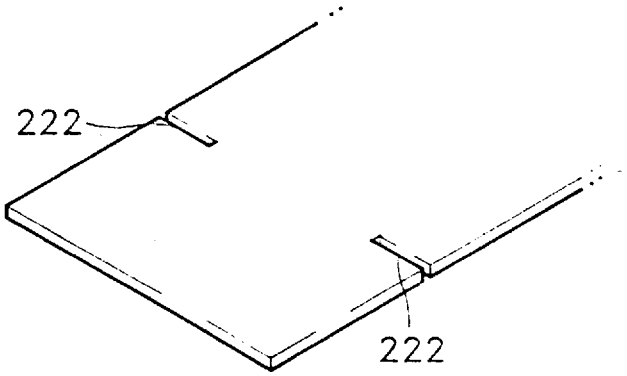
FIG. 2B (PRIOR ART)
Figure 2C:
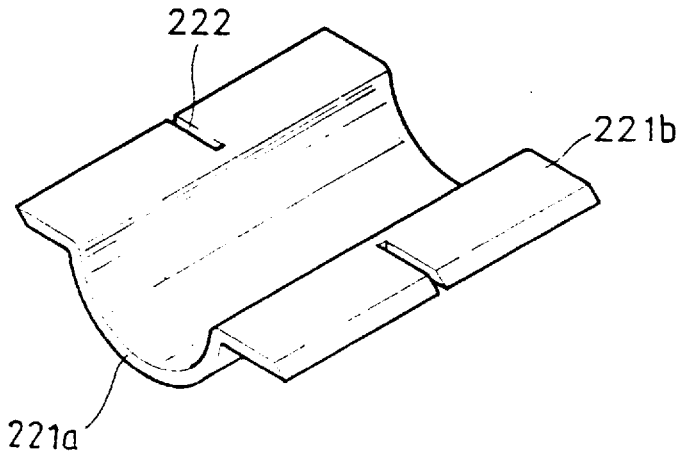
FIG. 2C (PRIOR ART)
Figure 2D:
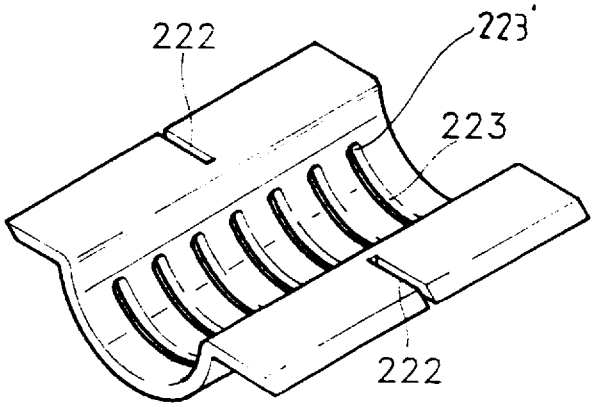
FIG. 2D (PRIOR ART)
Figure 2E:
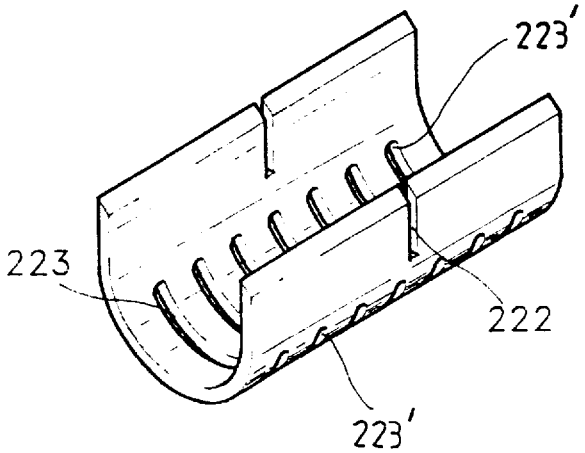
FIG. 2E (PRIOR ART)
Figure 2F:
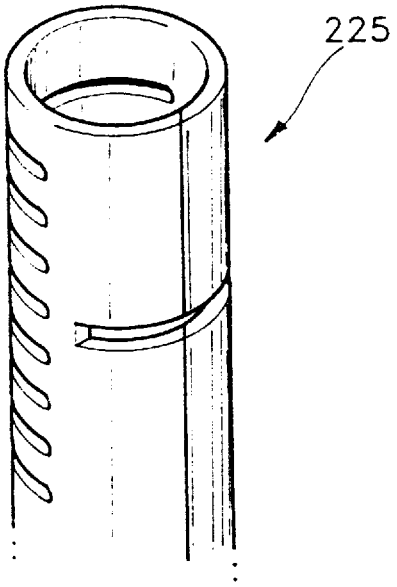
FIG. 2F (PRIOR ART)
Figure 2G:
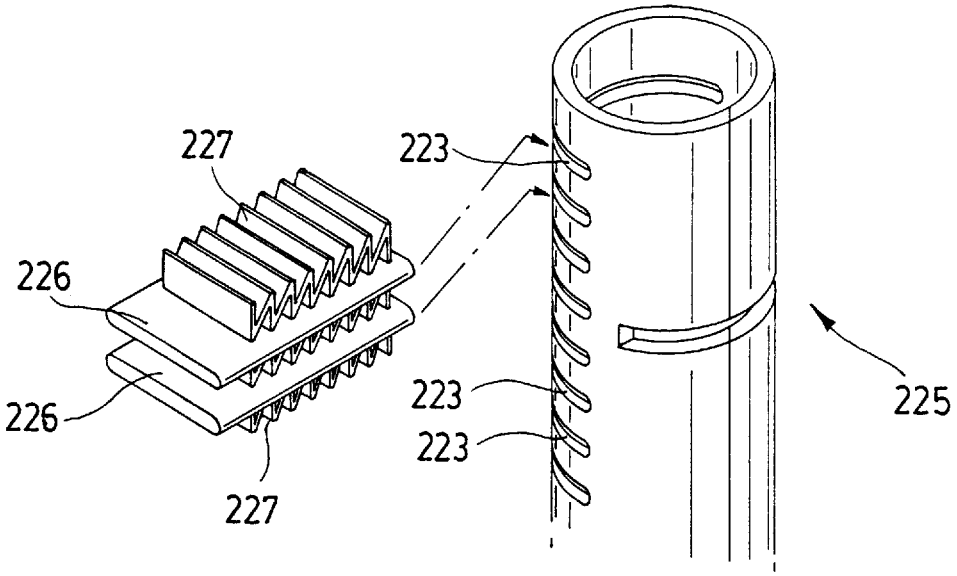
FIG. 2G PRIOR ART
Figures 1, 2H:
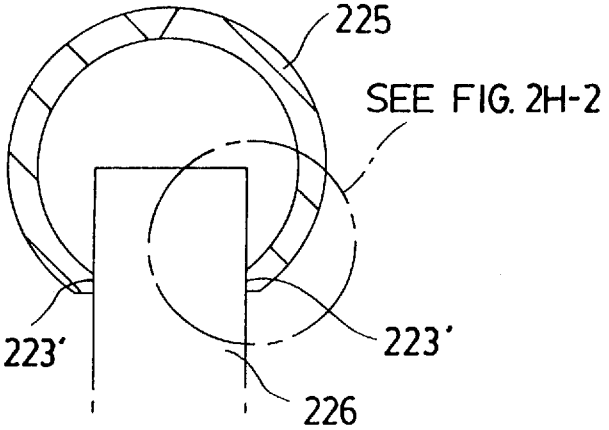
FIG. 2H-1 PRIOR ART
Figures 2, 2H:
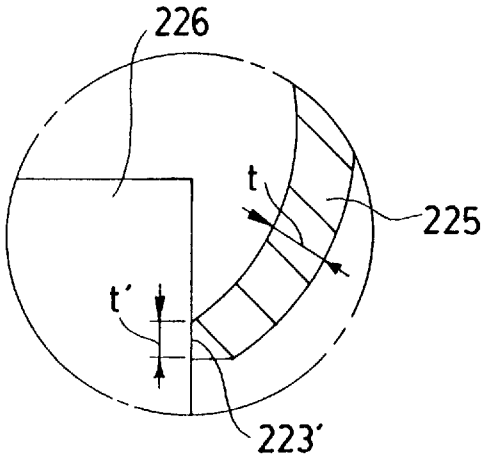
FIG. 2H-2 PRIOR ART
Figure 3:
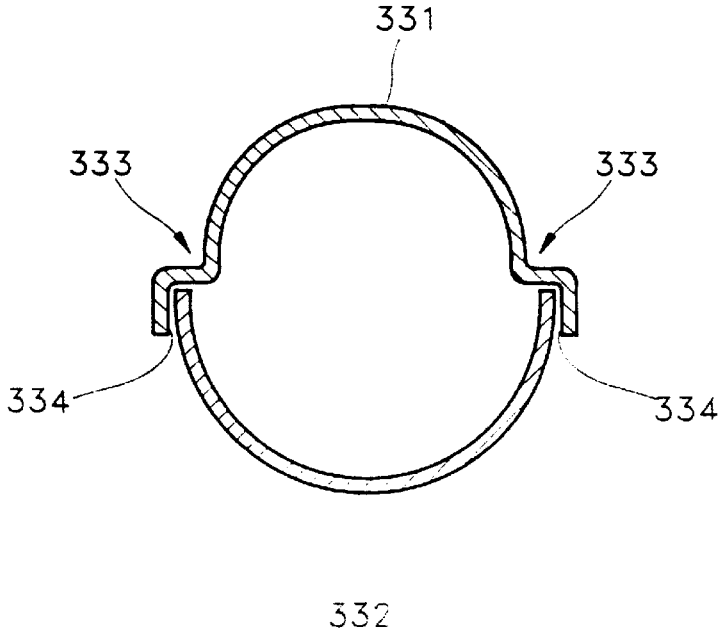
FIG. 3 (PRIOR ART)
FIG. 3 is a cross section of another conventional header pipe for a heat exchanger.
Figure 4A:
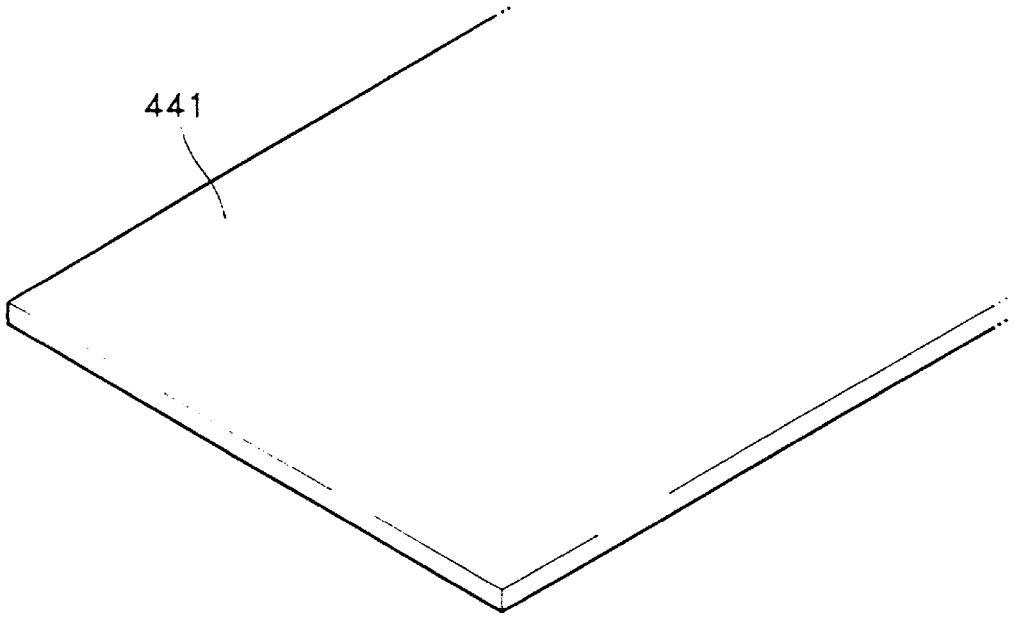
FIGS. 4A–4D are perspective views for explaining a manufacturing process of a header pipe for a heat exchanger according to an embodiment of the present invention.

In FIG. 4A, an aluminum sheet member 441 is provided for manufacturing the header pipe. The surface of the aluminum sheet should be coated with an aluminum cladding layer for brazing. The width of the aluminum sheet member 441 should be equal to or larger than the circumferential length of a cross section of the completed header pipe. The length thereof is the same as that of the completed header pipe.

Figure 4B:
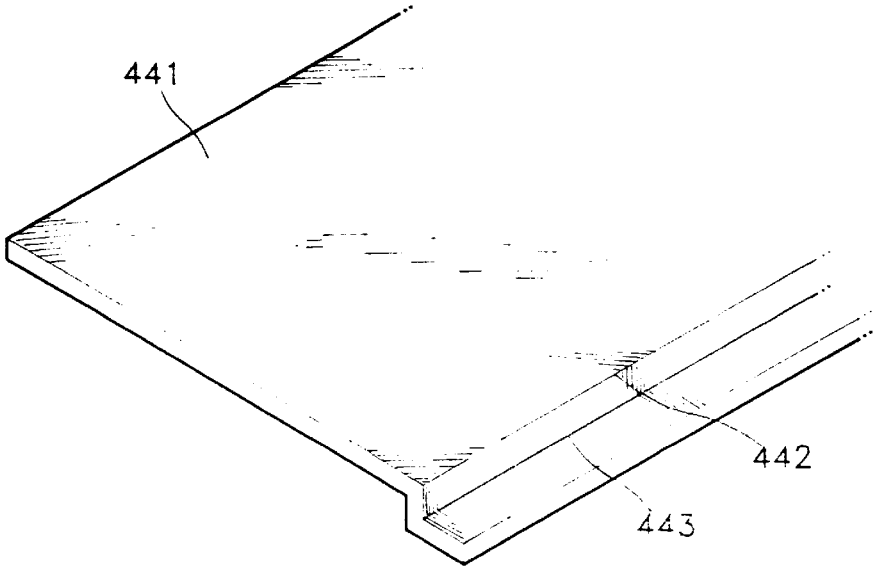

In FIG. 4B, one side edge of the aluminum sheet member 441 is bent along its length. First and second bent portions 442 and 443 are formed along the length of the sheet by bending the aluminum sheet member 441 twice at 90° angles. The formation of the first and second bent portions 442 and 443 is optional. The formation of the bent portions (442 and 443) is to facilitate brazing of the sheet member 441 which will be rolled later and improve coupling strength. In another embodiment to be described later, the side edges of the sheet material may be slanted for coupling of the sheet edges.

Figure 4C:
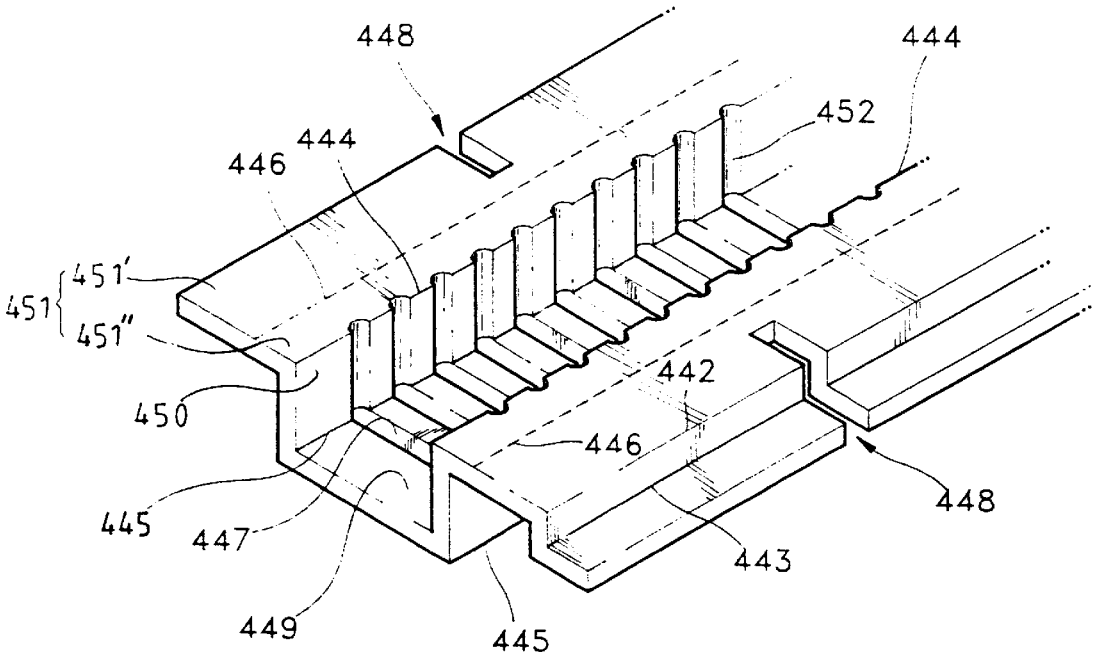

Referring to FIG. 4C, slits 448, a plurality of tube connecting apertures 447, third bent portions 444 and fourth bent portions 445 are formed in the sheet member shown in FIG. 4B. A dotted line indicated by a reference numeral 446 is for showing the position of a fifth bent portion to be formed later.

The third and fourth bent portions 444 and 445 are formed by bending the sheet member 441 at approximately 90° angles so that a header pipe having a flat bottom portion 449 and vertical walls 450 extending approximately perpendicularly from the flat bottom portion 449 is formed. Also, a horizontal portion 451 is formed which is approximately perpendicular to the vertical wall 450 and is parallel to the flat bottom 449.

Figure 4D:
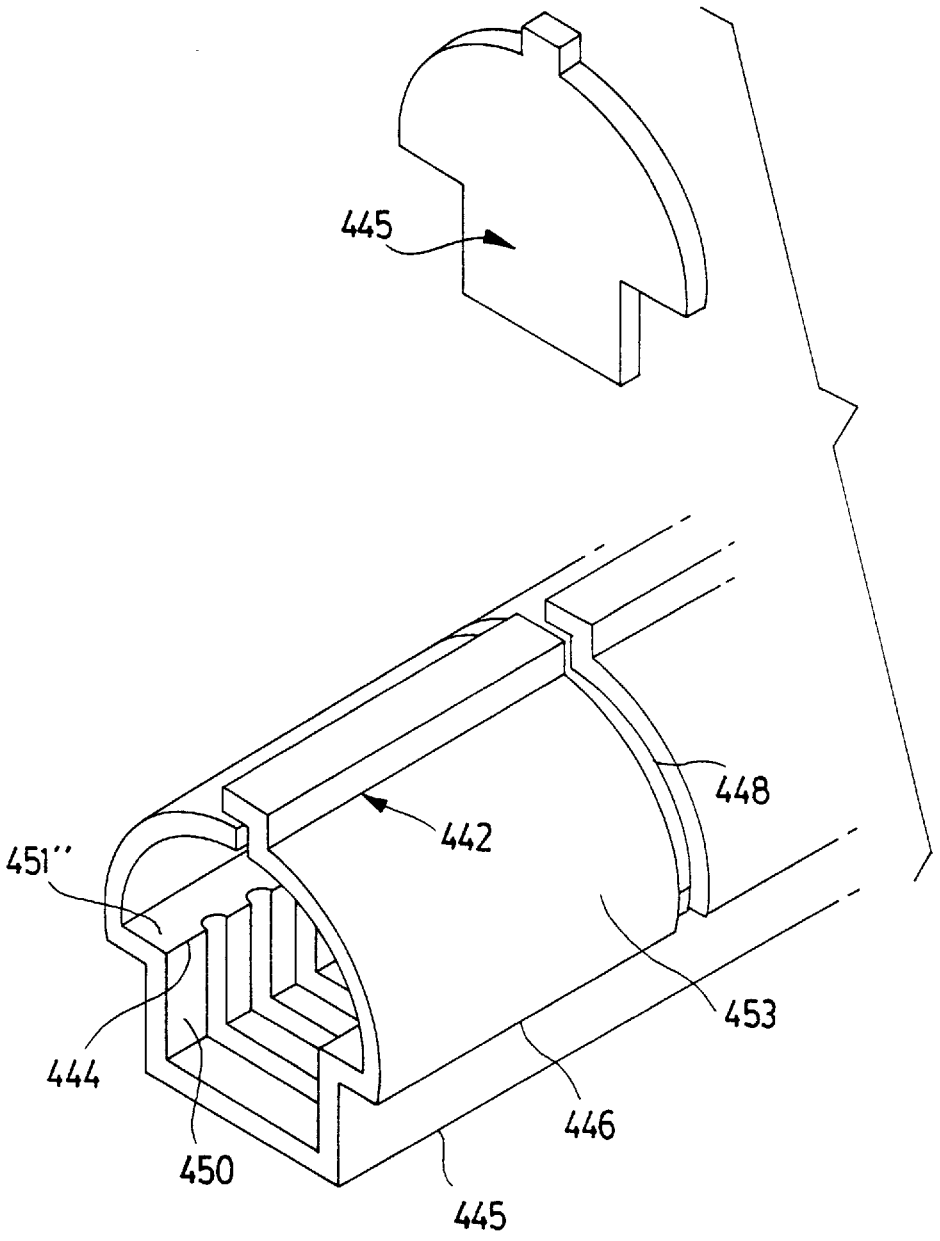

Referring to FIGS. 4C and 4D, the horizontal portion 451 is divided by the boundary of the fifth bent portion 446 into a first horizontal surface 451' and a second horizontal surface 451". In the completed header pipe, the outer portion forming the first horizontal surface 451' forms a semicircular curved portion 453 by being bent into an arc shape again as shown in FIG. 4D.

The tube connecting apertures 447 are arrayed on the flat bottom 449. The apertures 447 are holes formed by severing a part of the sheet member 441 in the width direction. As shown in the drawing, a plurality of connecting apertures 447 are arrayed at predetermined intervals along the lengthwise direction of the sheet member 441. The end of the tube of a heat exchanger is inserted into the header pipe via the aperture 447 and secured by brazing.

A plurality of tube guide grooves 452 for guiding the tube inside the header pipe are formed in the vertical wall 450, extending from the apertures 447 to the third bent portions 444. It is preferable that the cross section of the tube guide groove 452 be formed with the shape of the outer surface of the tube edge. That is, when the tubes are inserted into the apertures 447, the tubes move along the tube guide grooves 452 inside the header pipe while the outer surface of the tube contacts the groove surface.

On the one side of the horizontal portion 451 perpendicular to the vertical wall 450, the slits 448 can be formed for receiving a baffle to change the flow and length of the heat exchange medium as described earlier. As shown in FIG. 4C, the slit 448 is formed to have a predetermined length, extending from the side edge of the sheet member 441. The formation of the slit 448 is optional and its position can be varied as desired.

Referring to FIG. 4D, it is shown that the horizontal portion 451 of FIG. 4C is bent along the dotted line 446. The first horizontal surface 451' is to be changed into a curved portion 453 as described above. Both sides of the aluminum sheet member 441 come to contact each other to be capable of being brazed. Inside the header pipe, a hollow passage for the heat exchange medium is formed. As shown in the drawing, the cross-sectional shape of the header pipe has a rectangular portion where the tube apertures 447 and the tube guide grooves 452 are formed and a semi-circular portion enclosed by the curved portion 453.

Figure 5A:
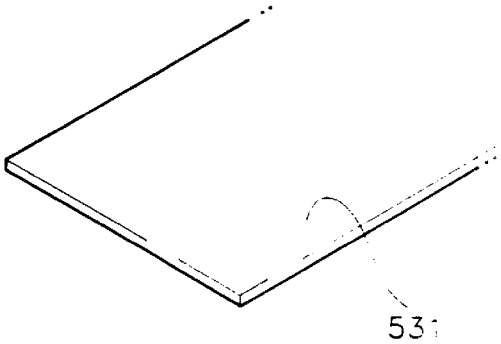
FIGS. 5A–5E are perspective views for explaining a manufacturing process of a header pipe for a heat exchanger according to another embodiment of the present invention.
Figure 5B:
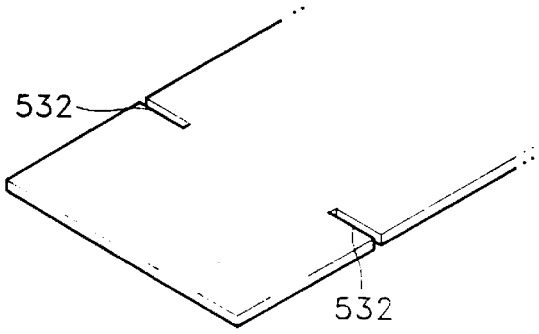

Referring to FIGS. 5A–5E, a method of manufacturing a header pipe for use in a heat exchanger according to another embodiment of the present invention will be shown. In FIG. 5A, an aluminum sheet member 531, which is coated with an aluminum cladding layer and is to be processed into a header pipe, is illustrated. The width and the length of the sheet member 531 correspond to the circumferential length and the length of the completed header pipe. In FIG. 5B, slits 532 are selectively formed in the sheet member 531.

Figure 5C:
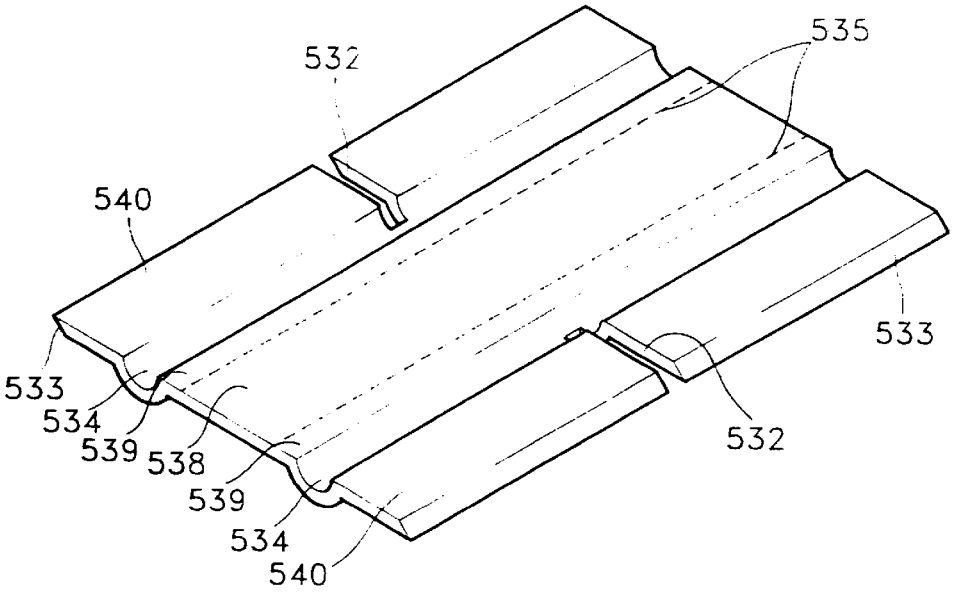

FIG. 5C shows the curved portions 534 and the inclined edges 533 in the aluminum sheet member 531. Dotted lines 535 indicate the locations of bending in the sheet member to be processed later. The midportion disposed between the dotted lines 535 will form a flat bottom 538 where apertures for receiving tubes will be formed in a completed header pipe. The curved portions 534 are formed along the length of the aluminum sheet member 531 at both sides of the flat bottom 538. The curved portions 534 are formed to bulge outward from the completed header pipe. Between the flat bottom 538 and the curved portions 534, flat vertical walls 539 will be formed approximately perpendicular to the flat bottom 538 when the aluminum sheet 531 is bent along the dotted lines 535 later. Wing portions 540 are disposed at both sides of the curved portions 534. The wing portions 540 will be rolled to form a curved portion, i.e., a cylindrical portion in which the cross section is semi-circular in the completed header pipe. Also, the inclined edges 533 are formed so as to facilitate brazing of the edges of the aluminum sheet member 531.

Figure 5D:
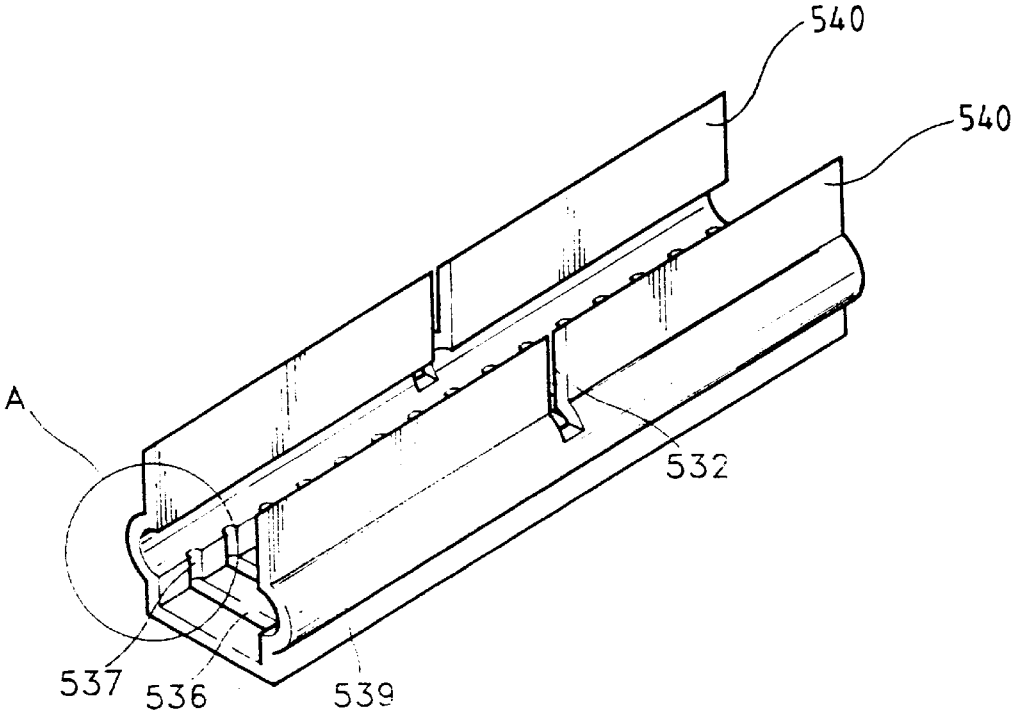
Figure 5E:
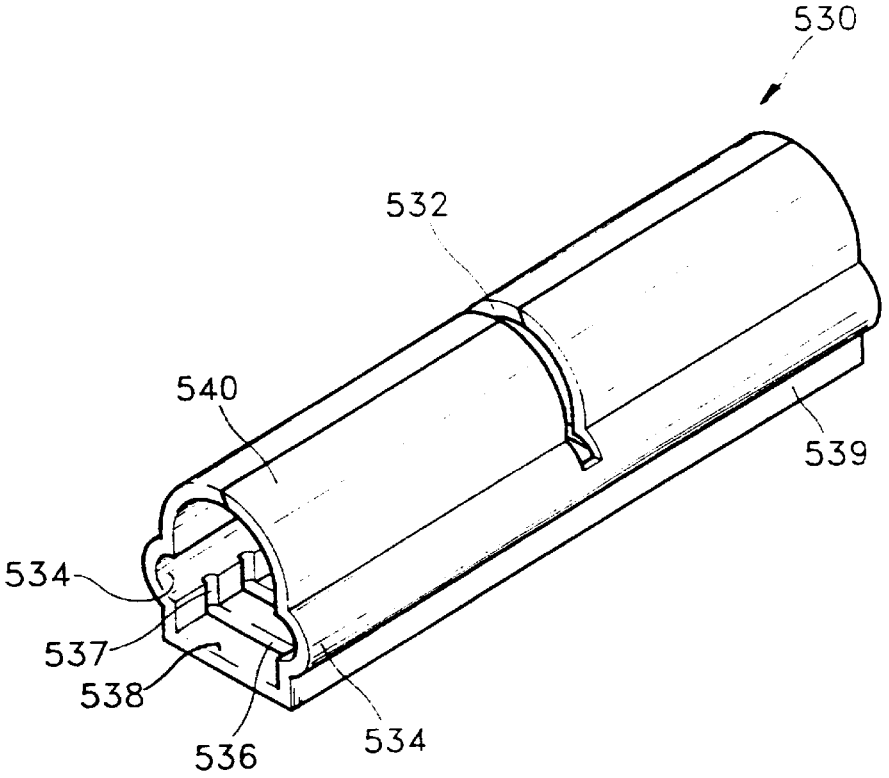

FIG. 5D illustrates the wing portions 540 bent along the dotted lines 535 shown in FIG. 5C. The wing portions 540 are bent along the dashed lines 535 at about 90° angles. A plurality of apertures 536 where tubes (not shown) are to be inserted are formed in the flat bottom 538 as shown FIG. 5D. Tube guide grooves 537, which can be formed by press work, are formed on the vertical walls 539. When the tubes are inserted into the header pipe, the end portions of the tubes are guided by the tube guide grooves 537. FIG. 5E shows a completed header pipe 530 wherein the wing portions 540 of FIG. 5C are bent inward to enable the inclined edges 533 of FIG. 5C to be brazed to each other.

Figure 6:
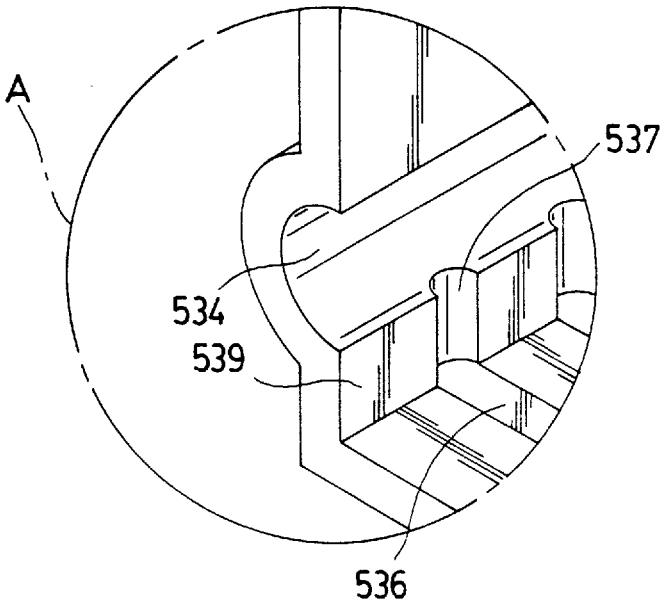
FIG. 6 is a magnified view of the portion indicated by circle A in FIG. 5D.

FIG. 6 is an enlarged view of circle A shown in FIG. 5D. The tube guide grooves 537 extend from the apertures 536 up to the underside of the curved portion 534.

Figure 7A:
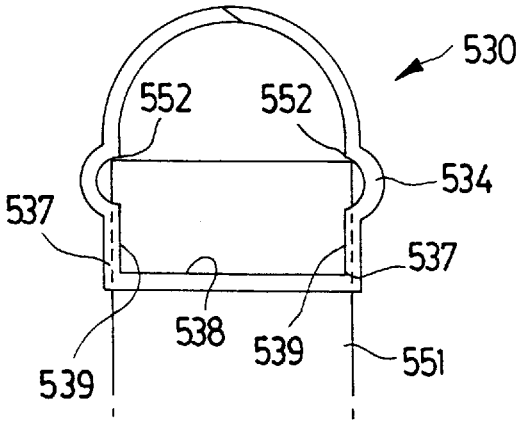
FIG. 7A is a cross-sectional view of a header pipe, manufactured in accordance with the method shown in FIGS. 5A to 5E, in which flat tubes have been inserted.

FIG. 7A shows a cross-sectional view of the header pipe 530 formed according to the method illustrated by FIGS. 5A–5E and tubes 551 inserted thereinto. The tubes 551 are inserted into the tube connecting apertures 536 and guided by the tube guide grooves 537. Since the guide grooves are formed on the vertical walls 539, and the widths of the tubes 551 correspond to the sum of the depths of the tube grooves 537 and the inner width of the flat bottom 538, the tubes 551 can be inserted past the curved portions 534 into the header pipe 530. However, the tubes 551 can not be inserted past the points indicated by reference numeral 552. Brazing between the tubes 551 and the header pipe 530 can be made between the tube guide grooves 537 and the tubes 551 as well as between the tubes 551 and the apertures 536, so that the brazing area may become larger than that of the conventional technology. While being formed into the header pipe, the sheet member is preferably coated with the aluminum cladding material only on the outer surface.

Figure 7B:
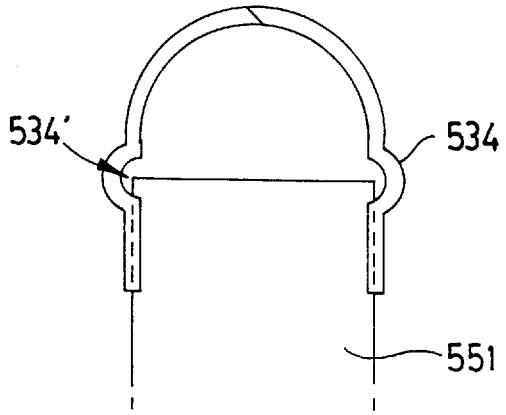
FIG. 7B is a cross section of another header pipe, manufactured in accordance with the method shown in FIGS. 5A to 5E, in which flat tubes have been inserted.

FIG. 7B shows yet another embodiment of the present invention in which the ends of the tubes do not contact the inner surface of the header pipe when the tubes are inserted into the header pipe. Referring to the drawing, the tubes 551 are inserted into the header pipe till the end portion of the tube 551 is stopped at a predetermined position of the space 534' in the curved portion 534. In this embodiment, the aluminum cladding flowing toward the tube 534 by melting when brazing work is being performed flows into the inner space 534' of the curved portion 534 around the tube 551 so as not to flow into the end portion of the tube 551 so that clogging in the ends of the tubes 551 by melted aluminum cladding can be avoided. Contrary to FIG. 7A, although all the inner and outer sides of the header pipe are coated with the aluminum cladding material, since the cladding material accumulates in the space 534', the clogging of the tube apertures can be prevented.

Figure 8A:
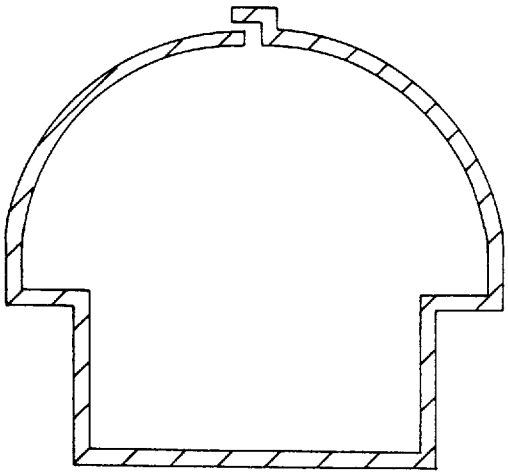
FIGS. 8A–8C are cross-sectional views illustrating coupling methods of the header pipe.
Figure 8B:
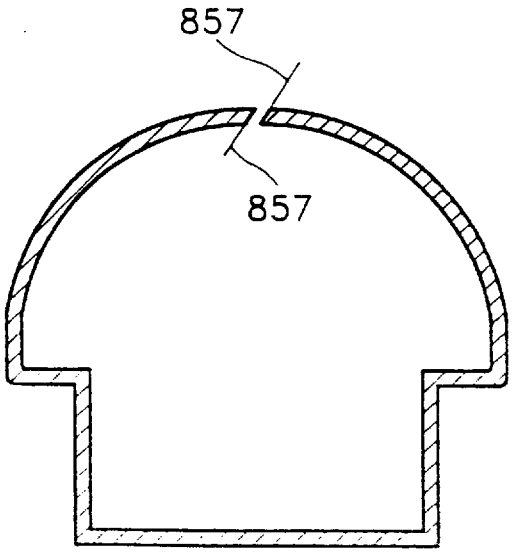
Figure 8C:
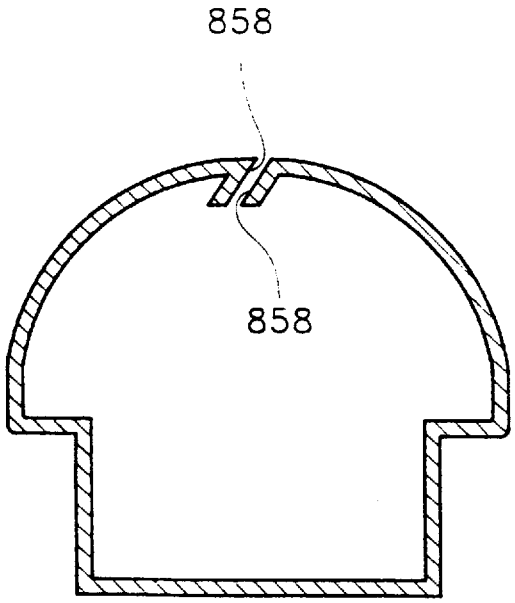

FIGS. 8A–8C show various embodiments of joining the side edges of the aluminum sheet member 441.

Referring to FIG. 8A, the joining of the edges is completed following the example shown in FIGS. 4A to 4D. This embodiment is characteristic in that joining strength can be improved since the brazing area is large.

Referring to FIG. 8B, inclined surfaces 857 are formed at the side edges of the aluminum sheet and the brazing is performed therebetween in the manner explained earlier in the example shown in FIGS. 5A–5E.

Referring to FIG. 8C, contacting surfaces 858 are formed by bending both side edges of the aluminum sheet into the header pipe.

The joining methods described in FIGS. 8A to 8C can be applicable for all the embodiments described above.

Figure 9:
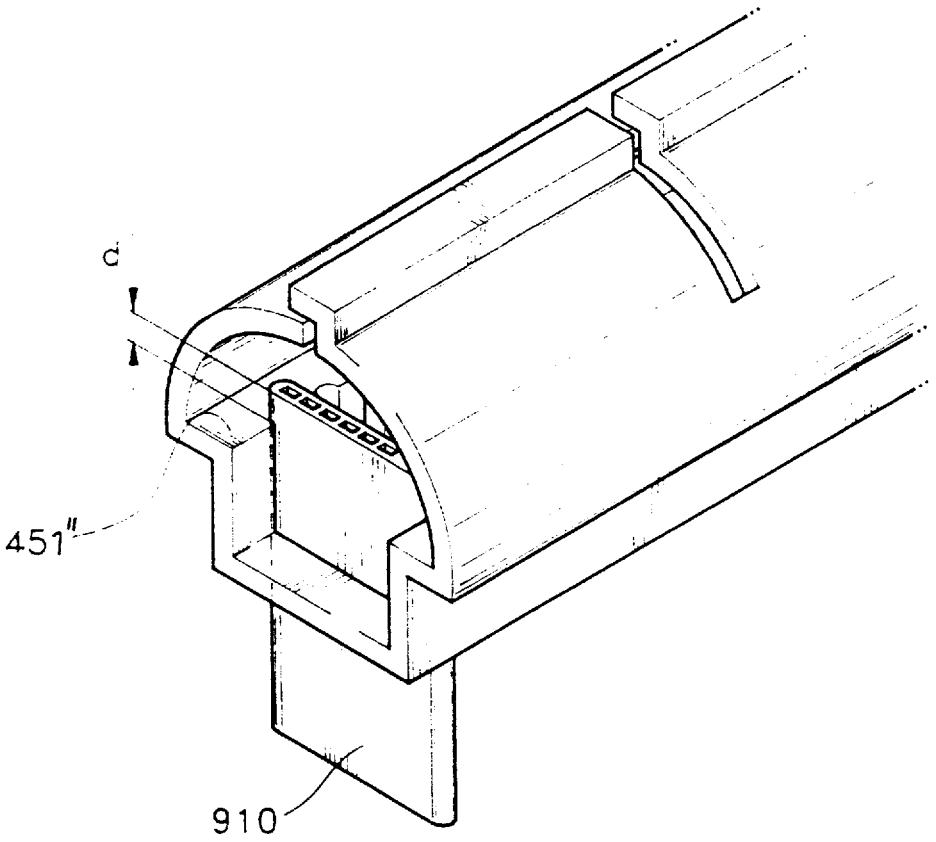
FIG. 9 is a perspective view illustrating the state of the flat tube inserted into the header pipe formed according to the method shown in FIGS. 4A to 4D.

FIG. 9 shows tubes inserted into the header pipe shown in FIG. 4D. It is preferred to insert tubes 910 into the header pipe such that the end of tubes 910 extend a predetermined distance "d" from the second horizontal surfaces 451' of the header pipe. This is to prevent melted aluminum cladding from flowing into the holes for passing the heat exchange medium of the tubes 910 during brazing.

Figure 10C:
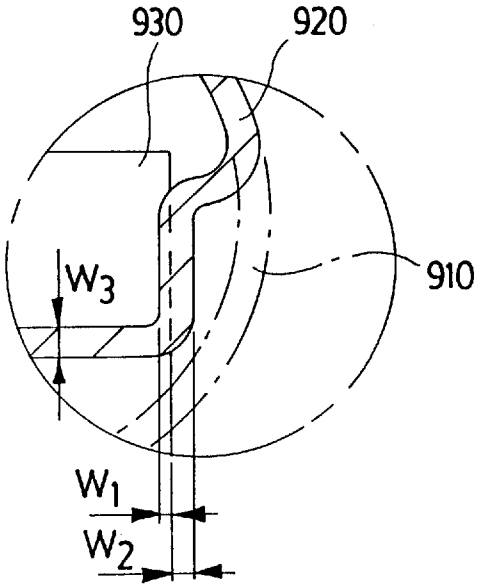
FIG. 10C is an enlarged view showing a part of FIG. 10A.
Figure 10B:
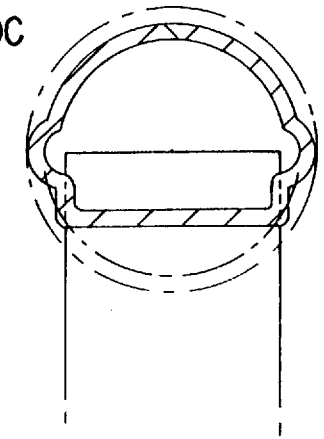
FIGS. 10A–10B are cross sections illustrating a state where the conventional circular header pipe overlaps the header pipe of the present invention.
Figure 10A:
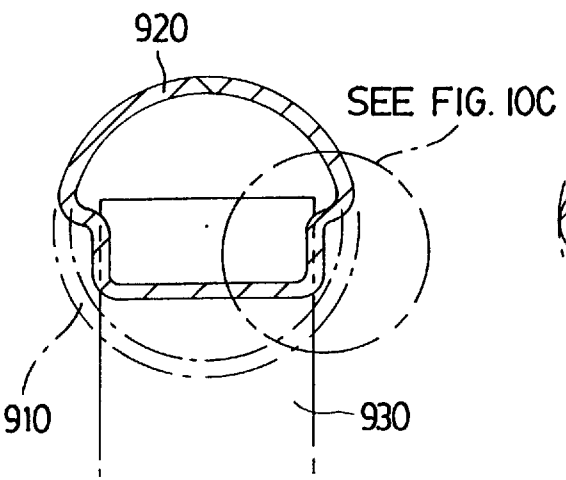

FIGS. 10A–10C illustrate a state where a cross-sectional view of the conventional circular header pipe overlaps that of the header pipe according to the present invention, drawn to the same scale, to compare the two header pipes. Referring to FIGS. 10A and 10C, the header pipe according to the conventional technology is indicated by reference numeral 910 and an imaginary line and the header pipe shown in FIGS. 8A through 8C is indicated by reference numeral 920 and a hatched section. As shown in FIGS. 10A and 10B, the area of the side portion of the tube 930 inserted into the header pipe 920 according to the present invention contacting the header pipe 920 is larger than that of the side portion of the tube 930 inserted into the conventional header pipe 910 contacting the header pipe 910. This means that heat transfer from the header pipe 920 according to the present invention to the tube 930 can be efficiently made and the header pipe 920 can support the tube 930 more firmly in regard to strength.

In FIG. 10C, $W_1$ is the depth of the tube guide groove formed in the interior surface of the header pipe 920 such that the tube 930 can be inserted thereinto and $W_2$ is the length generated by subtracting $W_1$ from $W_3$ which is the thickness of the header pipe 920. According to experiments, when $W_1$ is equal to or less than 40% of $W_3$, the heat transfer effect and the support effect become optimal.

As described above, the heat exchanger according to the present invention can be configured into a compact size since the cross section of the header pipe is not circular as in the conventional header pipe. Also, since the unnecessary space formed during the joining of the header pipe and the tubes can be removed, the flow of the heat exchanging medium is improved. Further, firmer joining between the header pipe and the tubes can be made because the brazing is not performed only between the tube receiving apertures and the guide grooves and the tubes. The guide grooves formed inside the header pipe facilitates the insertion of the tube into the header pipe to provide more convenience. Since the shape of the header pipe is simple, the overall weight of the heat exchanger decreases so that miniaturization and reduction in weight are possible. Also, by adjusting the shape of the curved portions or the inserted length of the tube into the header pipe, clogging of the tube by melted aluminum during the brazing work can be prevented.

It is noted that the present invention is not limited to the preferred embodiments described above, and it is apparent that variations and modifications by those skilled in the art can be effected within the spirit and scope of the present invention defined in the appended claims.

What is claimed is:

1. A method for manufacturing a header pipe for a heat exchanger comprising the steps of:

forming a flat bottom portion and a pair of vertical walls approximately perpendicular to side ends of the bottom portion on a sheet member coated with a cladding layer;

forming a plurality of tube connecting apertures for receiving a plurality of tubes in the flat bottom portion and a plurality of tube guide grooves extending from the tube connecting apertures on the vertical walls;

forming a curved portion by bending both side edges of the vertical walls; and joining side edges of the curved portion by brazing.

2. The method for manufacturing a header pipe for a heat exchanger as claimed in claim 1, further comprising the step of forming a second horizontal portion outwardly extending from the header pipe between the vertical walls and the curved portion.

3. The method for manufacturing a header pipe for a heat exchanger as claimed in claim 1, further comprising the step of forming a bulged portion bulging outward between the vertical walls and the curved portion.

* * * * *